US007156045B2

(12) United States Patent
Ueno et al.

(10) Patent No.: US 7,156,045 B2
(45) Date of Patent: Jan. 2, 2007

(54) COATING MACHINE

(75) Inventors: Takao Ueno, Aichi (JP); Takao Nomura, Aichi (JP)

(73) Assignee: Trinity Industrial Corporation, Toyota (JP)

( * ) Notice: Subject to any disclaimer, the term of this patent is extended or adjusted under 35 U.S.C. 154(b) by 0 days.

(21) Appl. No.: 10/938,508

(22) Filed: Sep. 13, 2004

(65) Prior Publication Data

US 2005/0092238 A1 May 5, 2005

(30) Foreign Application Priority Data

Sep. 12, 2003 (JP) ..... 2003-322146
Apr. 8, 2004 (JP) ..... 2004-114307

(51) Int. Cl.
*B05C 7/02* (2006.01)
*B05D 1/04* (2006.01)

(52) U.S. Cl. ..... 118/50.1; 118/620; 118/626; 118/629; 118/300; 222/94; 222/96; 222/105; 239/690; 239/708

(58) Field of Classification Search ..... 118/50.1, 118/620–629, 300; 222/92–107; 239/690–708
See application file for complete search history.

(56) References Cited

U.S. PATENT DOCUMENTS 3,270,920 A * 9/1966 Nessler ..... 222/95
3,809,484 A * 5/1974 Bradshaw ..... 401/185
4,561,037 A * 12/1985 MacLaine et al. ..... 361/228
5,152,466 A * 10/1992 Matushita et al. ..... 239/690
5,221,050 A * 6/1993 Jeffries et al. ..... 239/708
5,405,090 A * 4/1995 Greene et al. ..... 239/708
5,797,520 A * 8/1998 Donahue ..... 222/386.5
5,826,805 A 10/1998 Ito et al.
5,935,659 A * 8/1999 Cane et al. ..... 427/428.19
5,971,207 A * 10/1999 McDonough et al. ..... 222/1
6,019,144 A * 2/2000 Moulton ..... 141/1.1
6,953,155 B1 * 10/2005 Joseph et al. ..... 239/1
2003/0178059 A1 9/2003 Nomura et al.
2004/0251326 A1 * 12/2004 Pirrie ..... 239/690.1

FOREIGN PATENT DOCUMENTS

JP 2000-317354 11/2000

OTHER PUBLICATIONS

English language Abstract of JP 2000-317354.

* cited by examiner

*Primary Examiner*—Laura Edwards
(74) *Attorney, Agent, or Firm*—Greenblum & Bernstein, P.L.C.

(57) ABSTRACT

A coating machine having a coating material discharging mechanism for discharging a previously filled coating material under pressure to an atomizing mechanism wherein a coating material bag for filling a coating material is housed in a coating material discharging chamber of a predetermined volume and an inlet/exit port of an operating fluid is disposed for exerting a pressure from the outside of the coating material bag thereby discharging the coating material under pressure, while crushing the coating material bag, whereby paint or other coating material can be discharged under pressure reliably by a small driving force.

4 Claims, 6 Drawing Sheets

COATING MACHINE

BACKGROUND OF THE INVENTION

1. Field of the Invention

The present invention concerns a coating machine provided with a coating material discharging chamber for previously filling a coating material and discharging the same under pressure to an atomizing mechanism during coating and, more specifically, it relates to an electrostatic coating machine for electrostatically atomizing a conductive coating material such as an aqueous paint.

2. Statement of Related Art

In the coating of car bodies, coating materials using organic solvents are predominant, but it has been demanded to decrease volatile organic solvents that are evolved a great amount in the coating process with a view of environment protection and prevention of public pollution and, as a outer measure, coating with aqueous coating materials has attracted attention.

For using an aqueous coating with no loss, it is preferred to apply coating by an electrostatic coating apparatus of high coating efficiency. However, since the aqueous coating material has low electric resistance tending to electrically conduct the rotary atomizing head and the ground of the electrostatic coating machine by way of a coating material flowing through a coating material supply system, insulation has to be applied over the entire coating material supply system so as to prevent leakage of high voltage of −60 to 90 kV applied to the rotary atomizing head.

Accordingly, a coating material is filled in a coating material tank formed in a coating machine or a coating material is filled in a cartridge mounted detachably to a coating machine and a coating martial is discharged under pressure from the coating material tank or the cartridge for coating thereby electrically shielding the coating material supply system in order not to leak a high voltage even when it is applied to the coating machine (for example, refer to Japanese Unexamined Patent Publication No. 2000-317354).

In the electrostatic coating machine of the type described above, a bottom plate as a piston is slidably located along the inner peripheral surface of a coating material tank or a cartridge as a cylinder and the bottom plate is pushed by other actuator or under a reduced pressure to press-discharge the coating material.

However, since the bottom plate and the inner peripheral surface have to be sealed reliably, friction increases by so much to require a large driving force. Since the seal is worn by friction on every reciprocation of the bottom plate, an operating fluid may possibly enter to give an undesired effect on the quality of the coating in a case of liquid pressure driving.

Further, since plural O-rings are arranged in parallel to the outer peripheral surface of the bottom plate as a piston in the usual seal, the coating material intrudes between each of the O-rings and this imposes a trouble of decomposing and detaching the bottom plate and clean the same upon cleaning after completion of every day's job.

SUMMARY OF THE INVENTION

In view of the above, it is a technical subject of the present invention to provide a coating material-filled type coating machine capable of discharging under pressure a paint or like other coating material reliably with a small driving force without sliding movement of a bottom plate and, accordingly, with no trouble of decomposing cleaning by detaching the bottom plate.

The foregoing object of the invention can be attained by a coating machine having a coating material discharging mechanism for discharging a previously filled coating material under pressure to an atomizing mechanism wherein a coating material bag for filling a coating material is housed in a coating material discharging chamber of a predetermined volume, and an inlet/exit port for an operating fluid is disposed for exerting a pressure from the outside of the coating material bag thereby discharging the coating material under pressure.

In the coating machine according to the invention, when a coating material such as a paint is previously filled in a coating material by housed in a coating material discharge chamber and an operating fluid is supplied to the outside of the coating material bag, the operating fluid bag is expanded by the liquid pressure and the coating material bag is crushed by which the coating material is discharged under pressure by a predetermined amount and supplied to the atomizing mechanism.

As described above, since the coating material can be discharged under pressure by supplying the operating fluid thereby crushing the coating material bag, the pressure of the operating fluid is exerted as it is on the coating material and the coating material can be discharged under pressure with a relatively small driving force.

Further, since there is no more required to slide the bottom plate, there is no worry of coating failure caused by the leakage in the seal for the bottom late and since there is no gaps through which the coating material intrude, cleaning can be conducted simply.

In this case, when the coating material bag and the operating fluid bag are housed in the coating material discharge chamber, even when the operating fluid bag should be broken during use, since the coating material is filled in the coating material bag, there is no worry that the coating material and the operating fluid are mixed in the coating material discharge chamber.

In addition, when at least portions of the coating material bag and the operating fluid bag are bound to each other such that the contact faces of the coating bag and the operating fluid bag are not positionally displaced from each other, movement of the coating material bag and the operational fluid bag to each other are restricted when they are expanded or crushed alternately while repeating filling and discharging of the coating material and entry and exit of the operating fluid, whereby the two bags are deformed integrally.

Thus, since the contact faces of the coating material bag and the operating fluid reciprocate as if they were a single sheet of diaphragm in the coating material discharge chamber without forcing only the coating material bag, for example, to the corner of the coating material discharge chamber thereby compressing only the coating material bag, this can provide an advantageous effect that respective bags are less creased or broken.

Further when gaps between the coating material bag and the operating fluid bag are filled with a liquid, the pressure of the operating fluid transfers directly to the coating material bag because of the absence of air gaps, and the amount of the operating fluid supplied and the amount of the coating material discharged are made identical.

Further, when the coating material discharge chamber has a cylindrical inner peripheral surface, the coating material bag and the operating fluid bag are not folded even when they are urged to the coating material discharge chamber.

Furthermore, in a case where a conductive coating material such as an aqueous coating material is electrostatically atomized, as the coating material by an electrostatic atomizing mechanism, since the coating material is filled in the coating material bag, high voltage does not leak by way of the coating material to the outside and there is no requirement for applying insulation countermeasure to the coating material supply system.

DESCRIPTION OF THE ACCOMPANYING DRAWINGS

Preferred embodiments of the present invention will be described in details based on the drawings, wherein FIG. 1 is a cross sectional view showing an example of a filled-type coating machine according to the present invention (Embodiment 1);

Figure 4A:
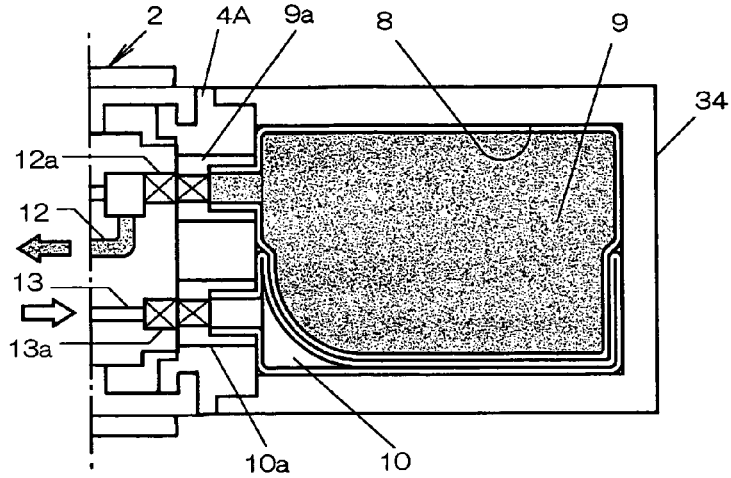
Figure 4B:
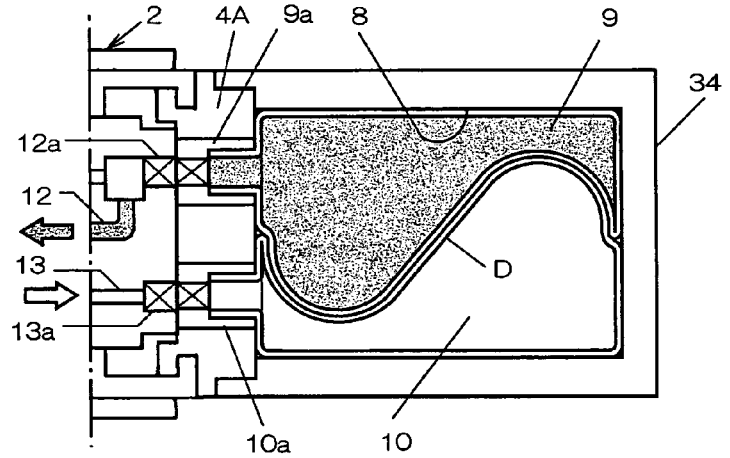
Figure 4C:
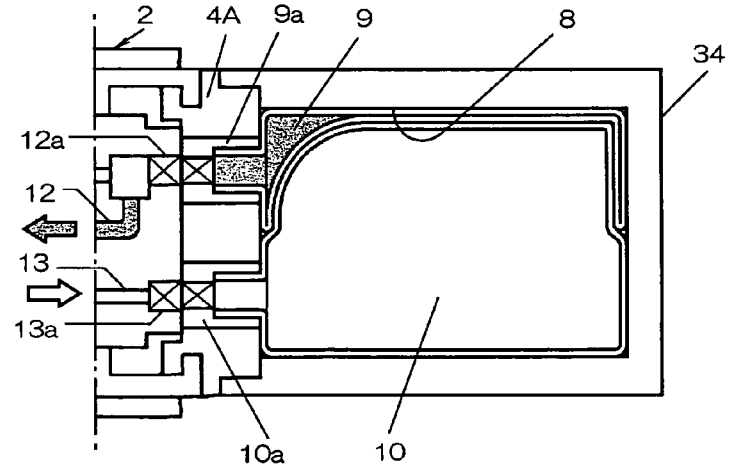
Figure 5A:
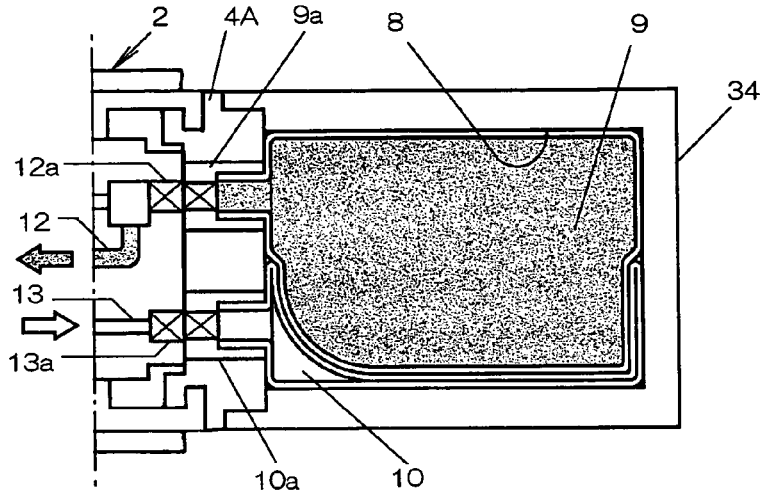
Figure 5B:
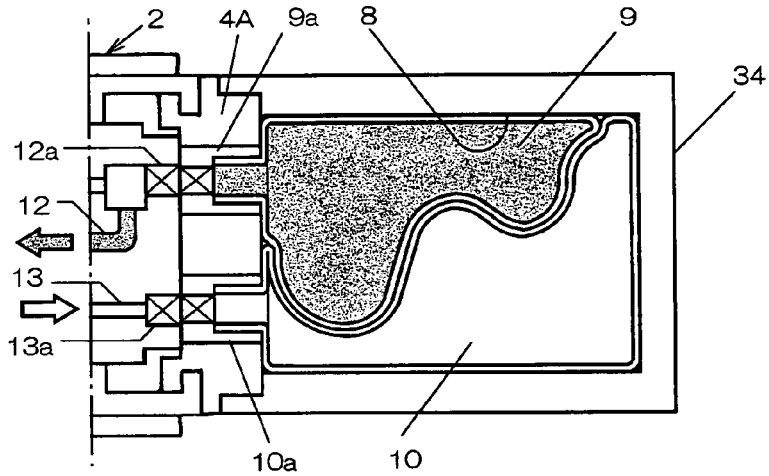
Figure 5C:
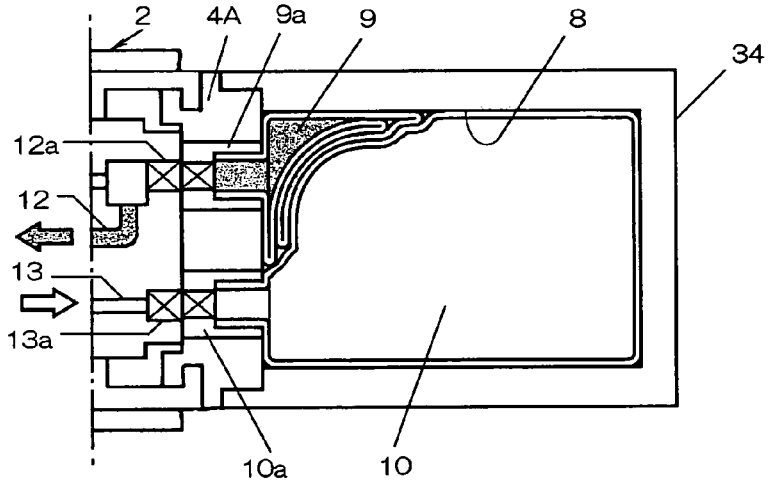
Figure 6:
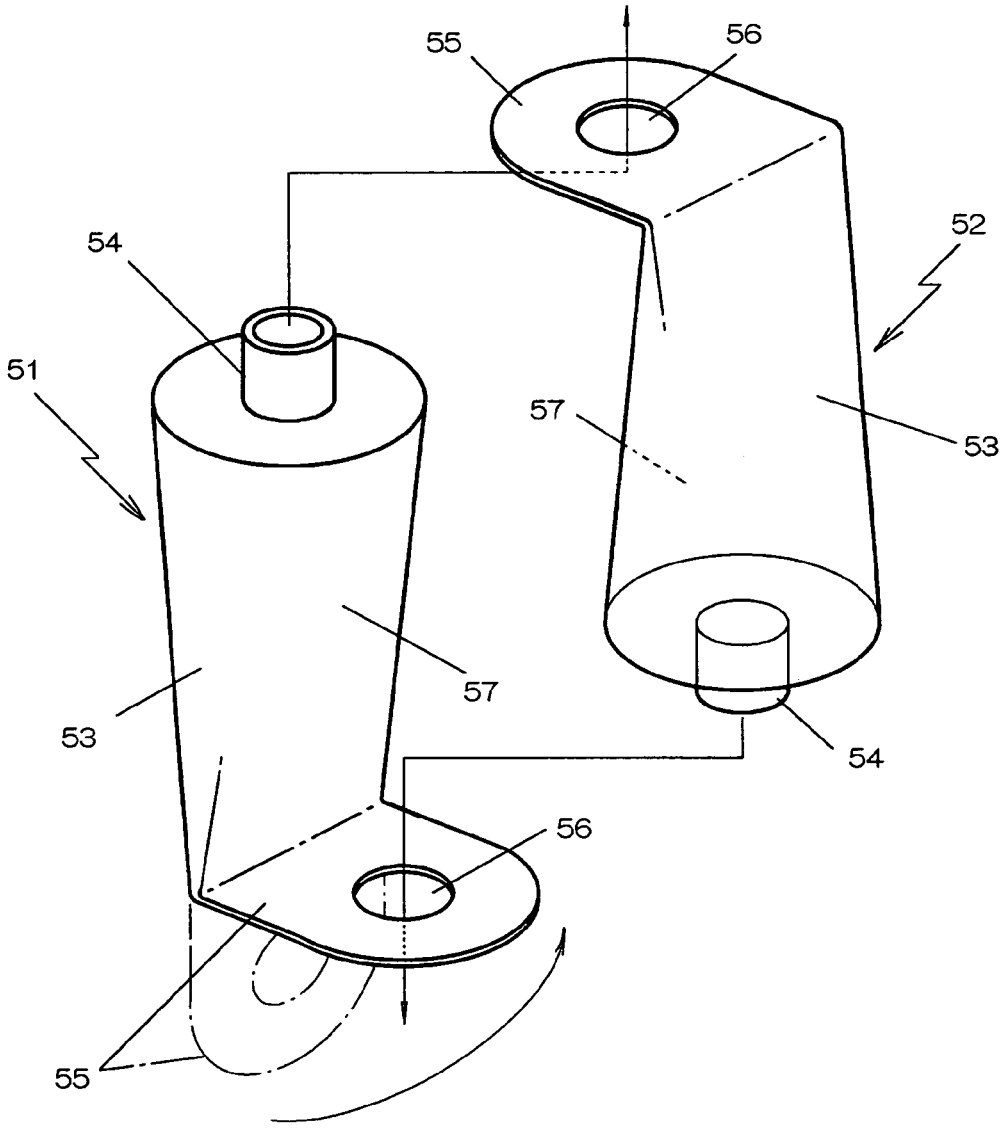

FIG. 4*a* is a conceptional view showing the state in which a coating material is filled in a coating material bag;

FIG. 4*b* is a conceptional view showing a state of supplying an operating fluid to an operating fluid bag;

FIG. 4*c* is a conceptional view showing a state in which the coating material bag is substantially emptied;

FIG. 5*a* is a conceptional view showing a state in which the coating material is filled in the coating material bag;

FIG. 5*b* is a conceptional view showing a state of supplying an operating fluid to an operating fluid bag;

FIG. 5*c* is a conceptional view showing a state in which the coating material bag is buckled; and FIG. 6 is a fluid circuit diagram showing another embodiment (Embodiment 2).

EMBODIMENTS 1

Figure 1:
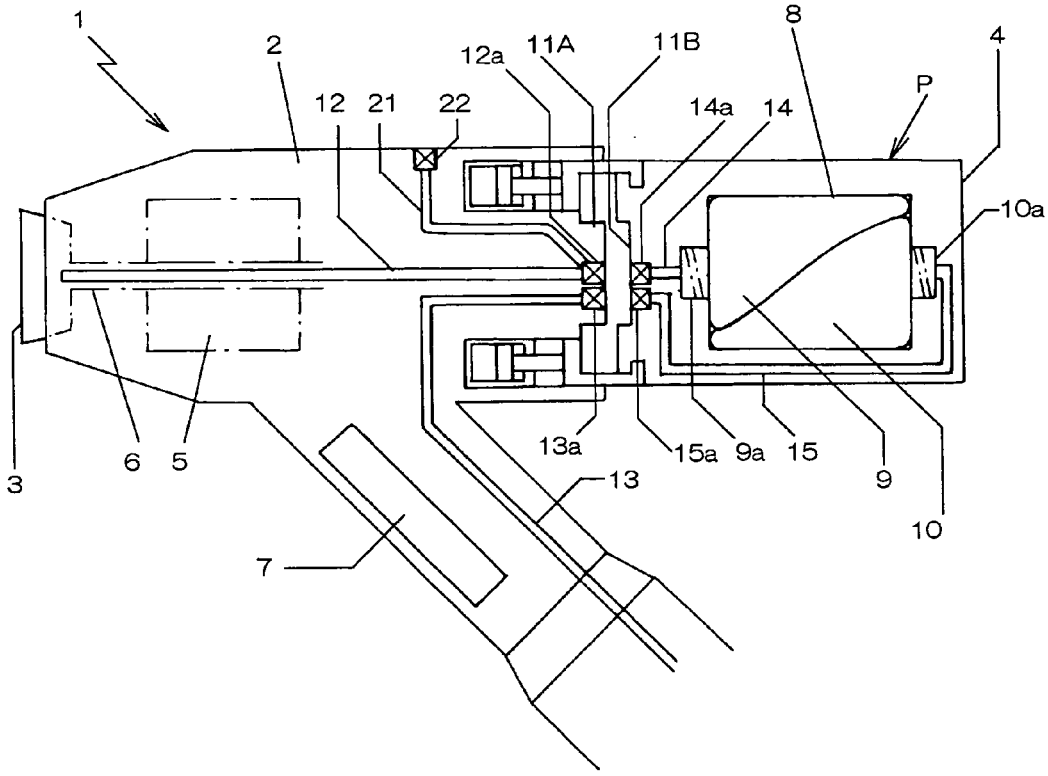

An electrostatic coating machine 1 shown in FIG. 1 is adapted to conduct electrostatic coating of a conductive coating material such as an aqueous coating paint, in which a rotary atomizing head for rotationally atomizing a coating material (atomizing mechanism) 3 is provided at the top end of the machine body 2, and a cartridge 4 having a coating material discharging mechanism P for discharging the coating material previously filled by the liquid pressure of the operating fluid is mounted detachably to the lower end thereof.

The rotational atomizing head 3 is attached to a tubular rotary shaft 6 of an air motor 5 located in the machine body 2 and driven rotationally at high speed. A high voltage supplied from the high voltage generator 7 is applied to the head 3 so as to electrically charge atomized coating material particles to a polarity opposite to that of an article to be coated.

In the coating material discharge mechanism P, a coating material inlet/exit port 9*a* and an operating fluid inlet/exit port 10*a* are formed in a coating material discharge chamber 8 of a predetermined volume. A coating bag 9 for filling the coating material is attached to the coating material inlet/exit port 9*a* and an operating fluid bag 10 for discharging coating material under pressure is attached to the operating fluid inlet/exit port 10*a* each in a detachable manner.

Each of the coating material bag 9 and the operating fluid bag 10 is formed into a tubular or balloon shape having a connection port being formed at one end, and each of the connection port is connected to each of the inlet/exit port 9*a* and 10*a*.

Thus, the operating fluid bag 10 is expanded by the operating fluid entering from the machine body 2 by way of the operating fluid inlet/exit port 10*a* to exert pressure on the outside of the coating material bag 9, by which the coating material bag 9 in the coating material discharge change 8 is crushed to discharge the coating material under pressure.

The coating material discharge chamber 9 has a cylindrical peripheral surface at the inside, and a pressure transfer liquid for transferring the pressure of the operating fluid flowing into the operating fluid bag 10 to the coating material bag 9 is filled to the outside of the coating material bag 9 and the operating fluid bag 10.

As the pressure transfer liquid, an operating fluid or a thinner is used and, in this embodiment, butyl acetate, which is identical wit the operating fluid is used.

Further, since the coating material is filled in the coating material bag 9, it does not adhere to the coating material discharge chamber 9 and even when the coating material which remains not being cleaned is cured in the coating material bag 9, it may suffice to exchange the coating material bag 9 which can facilitate the maintenance extremely.

Further, in this embodiment, each of the bags 9 and 10 is chosen so as to have a size and a volume substantially equal with those of the coating material discharge chamber 8, so that when the coating bag 9 is filled with the coating material, the operating fluid bag 10 is substantially emptied whereas when the operating fluid is filled in the operating fluid bag 10, the coating material bag 9 is substantially emptied.

When the cartridge 4 is mounted to the machine body 2, joints 11A and 11B are engaged to communicate flow channels between both of the machine body 2 and the cartridge 4.

The machine body 2 is provided with a coating material supply flow channel 12 for supplying the coating material discharged under pressure from the coating material bag 9 to the rotary atomizing head 3, and an operating fluid flow channel 13 for supplying/discharging the operating fluid to the operating fluid bag 10. The joint 11A is provided with connection ports 12*a* and 13*a* with stop valves which open the respective flow channels 12, 13 only when the joint 11A is combined with the joint 11B on the sides of the cartridge.

In the same manner, the cartridge 3 is provided with a coating material flow channel 14 in communication with the coating material bag 9 and an operating fluid flow channel 15 in communication with the operating fluid bag 10. The joint 11B of the cartridge is provided with connection ports 14*a*, 15*a* having stop valves that open when the joint 11B is engaged with the joint 11A on the side of the machine body 2 and each of the flow channels 14, 15 are in communication with the flow channels 12 and 13.

A cleaning flow channel 21 for cleaning the inside of the coating machine 1 and the rotary atomizing head 3 is in commutation from the cleaning connection port 22 formed to the peripheral surface of the machine body 2 to a connection port 12*a* of the coating material supply flow channel 12 and is in communication by way of a connection port 12*a* with the coating material supply flow channel 13 when the joints 11A and 11B are not in engagement.

The operation of the embodiment of the present invention as has been described above is to be explained below.

Various kinds of operation air pipelines, exhaust pipelines, power source cables (not illustrated) are connected with the machine body 2 of the electrostatic coating machine 1, and the electrostatic coating machine 1 is attached to a weaving arm of a coating robot (not illustrated).

Then, the cartridge 4 in which the coating material is previously filled in the coating material bag 9 is attached to the machine body 2, the joints 11A and 11B are engaged, and the coating machine 1 is located to an optional coating position. At the same time, the rotary atomizing head 3 is rotationally driven at a high speed by the air motor 5 and the high voltage generator 7 is turned on to apply a high voltage to the atomizing head.

Then, when the operating fluid is supplied at a constant amount from the machine body 2 to the cartridge 4, since the operating fluid bag 10 is expanded and the coating material bag 9 is crushed between the operating fluid bag 10 and the inner wall of the coating material discharge chamber 8, the coating material is supplied by a predetermined amount by way of the coating material supply flow channel 12 and electrostatically atomized in the rotary atomizing head 3.

According to this embodiment, since the coating material is not discharged under pressure by the sliding movement of the bottom plate for the coating material tank or the cartridge as usual but since the coating material can be discharged under pressure by flowing the operating fluid into the operating fluid bag 10 thereby crushing the coating material 9, the pressure of the operating fluid exerts as it is on the coating material, it can provide an effect capable of discharging the coating material under pressure with a relatively small driving force.

Further, since the coating material is filled in the coating material bag 9 and completely separated from the operating fluid, it is no more necessary to provide a seal for preventing them from mixing with each other and, accordingly, coating failure caused by leakage of seal does not occur. Further, since no gaps through which the coating material intrudes are present, it has also an advantageous effect capable of conducting cleaning simply.

EXAMPLE 2

Figure 2:
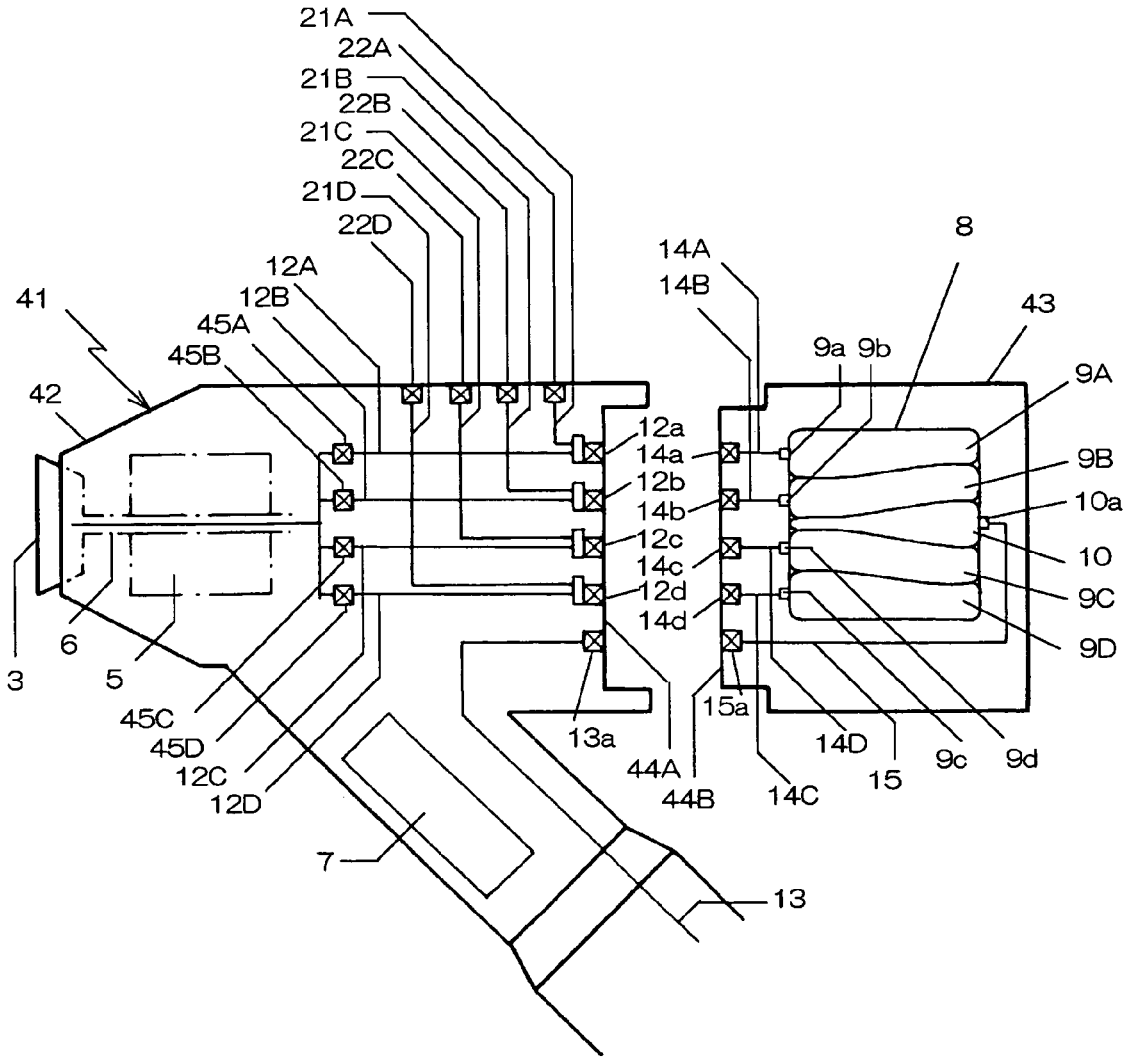
FIG. 2 is a fluid circuit diagram showing another embodiment (Embodiment 2)

FIG. 2 is an explanatory view showing another embodiment according to the invention. Those portions in common with FIG. 1 carry same reference numerals for which detailed descriptions are to be omitted.

In an electrostatic coating machine 41 of this embodiment, coating material inlet/exit ports 9*a* to 9*d* and an operating fluid inlet/exit port 10*a* are formed to a coating material discharge chamber 8 of a cartridge 43 mounted to a machine body 42. Plural coating material bags 9A to 9D for filling aqueous coating materials of respective colors are attached to coating material inlet/exit ports 9*a* to 9*d*, and an operating fluid bag 10 for discharging the coating material under pressure is attached to the operating fluid inlet/exit port 10*a*, respectively, in a detachable manner.

The coating material bags 9A to 9D and the operational fluid bag 10 are formed each in a tubular or balloon shape having a connection ports formed at one end, each of the connection port is connected with each of the inlet/exit ports 9*a* to 9*d* and 10*a*. The coating material bags 9A to 9D are disposed each by two on both sides of the operating fluid bag 10 so as to sandwich the same therebetween.

Further, each of the coating material bags 9A to 9D is selected so as to have about ¼ volume of the coating material discharge chamber 8, and the operating fluid bag 10 is selected so as to have a volume substantially equal with that of the coating material discharge chamber 8 such that all the coating material bags 9A to 9D can be emptied.

The machine body 42 and the cartridge 43 are in communication with each other by both of their flow channels by way of joints 44A and 44B.

The machine body 2 is provided with coating material supply flow channels 12A to 12D for supplying the coating material discharged under pressure from each of the coating material bags 9A to 9D to the rotary atomizing head 3. ON-OFF valves 45A to 45D for communicating the coating material supply flow channels 12A to 12D with the rotary atomizing head 3 selectively upon discharge of the coating material, and an operating fluid flow channel 13 for supplying/discharging the operating fluid to the operating fluid bag 10.

Then, the joint 44A on the side of the machine body 42 is provided with connection ports 12*a* to 12*d*, and 13*a* with stop valves which are opened only when the joint 44A is engaged with the joint 44B on the side of the cartridge 43 at the top ends of the flow channels 12A to 12D, and 13 respectively.

The cartridge 43 is provided with coating material flow channels 14A to 14D in communication with the coating materials bags 9A to 9D, and an operating fluid flow channel 15 in communication with the operating fluid bag 10.

Then, the joint 44B on the side of the cartridge 43 is provides with connection ports 14*a* to 14*d*, and 15*a* with stop valves which are opened only when the joint 44B is engaged with the joint 44A on the side of the machine body 42, at the top ends of respective flow channels 14A to 14D, and 15.

Cleaning flow channels 21A to 21D for cleaning the inside of the coating machine 1 and the rotary atomizing head 3 are in communication from cleaning connector connection ports 22A to 22D formed at the peripheral surface of the machine body 2 to the connection ports 12*a* to 12*d* of the coating material supply flow channels 12A to 12D and they are in communication by way of the connection ports 12*a* to 12d with the coating material supply flow channels 12A to 12D in a case where the joints 44A and 44B are not in engagement.

In this embodiment, since plural coating material bags 9A to 8D are provided, it can be applied to multi-color coating under color change.

Further, since the pressure of the operating fluid exerts as it is on the coating material, the coating material can be discharged under pressure by a relatively small driving force and there is no worry of coating failure caused by seal leakage. In addition, cleaning can be conducted simply since seal gaps which may allow the intrusion of the coating material are not present. Such advantageous effects are identical with those of the embodiment described previously.

In each of the embodiments described above, the patent invention is applied to an electrostatic coating machine for use in conductive coating materials, but the invention is not restricted only thereto and is applicable also to usual electrostatic coating machines for non-conductive coating material or air atomizing coating machines.

EXAMPLE 3

Figure 3:
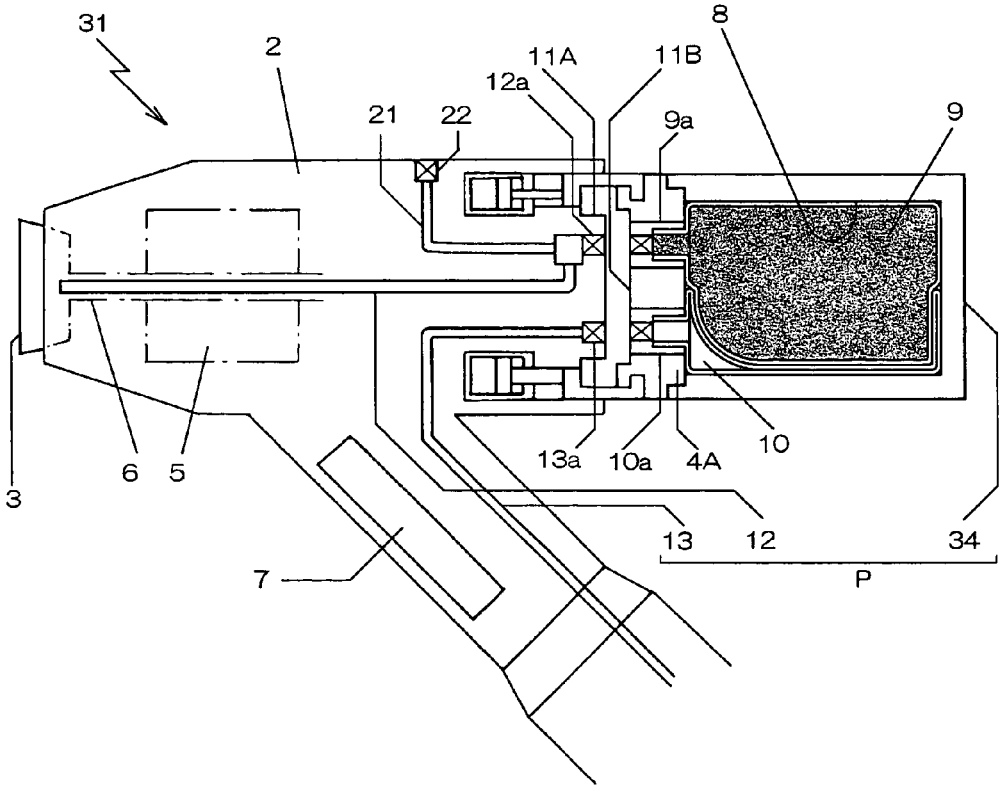
FIG. 3 is a fluid circuit diagram showing another embodiment (Embodiment 3)

FIG. 3 shows a further embodiment of the invention. Those portions in common with FIG. 1 carry identical reference numerals for which detailed descriptions are to be omitted.

In a cartridge 34 of an electrostatic charging machine 31 shown in FIG. 3, the front side of a coating material discharge chamber 8 having a cylindrical inner peripheral surface is formed as a lid 44, and the lid 4A is provided with a joint 11B to be connected with a joint 11A at the rear end of the machine body 2. The lid 4A is provided with a coating material inlet/exit port 9*a* for connecting the coating material bag 9 and an operating fluid inlet/exit port 10*a* for connecting the operating fluid bag 10.

The ports 9*a* and 10*b* are formed with male/female receptacles screw coupling with the male screws formed to the ports for each of the bags 9 and 10 and female screws formed to the lid 4A, and the ports are provided with a stop valves which are opened when the cartridge is mounted to the machine body 2.

Further, the coating material bag 9 and the operating fluid bag 10 are bond to each other at least portions thereof so that they are not positionally displaced at the contact faces thereof from each other. In this embodiment, while the bags 9 and 10 are welded on both sides thereof respectively, this is not limitative but they may be optionally bonded such that they are bonded at one or several positions in the central part of the joined faces, or bonded at the front surfaces thereof.

According to this embodiment, since the coating material bag 9 and the operating fluid bag 10 are bond to each other at least portions thereof so that the contact faces thereof are not positionally displaced from each other when the coating material bag 9 and the operating fluid bag 10 are expanded and crushed alternately while repeating charge and discharge of the coating material and entering and exit of the operating fluid, their mutual movement is restricted, and the two bags 9 and 10 are deformed integrally.

That is, in a case where they are not restricted as in the present invention, when the coating material bag 9 and the operating fluid bag 10 are expanded or crushed alternately while repeating charge and discharge of the coating material and entering and exit of the operating fluid, as shown in FIG. 5(*a*) to (*c*), it leaves a problem that only the coating material bag 9 is forced to the corner of the coating material discharge chamber 8 and only the coating material bag 9 is flexed under pressure, thereby tending to crease or break the respective bags.

However, when the coating material bag 9 and the operating fluid bag 10 are bonded to each other at least portions thereof as in the present invention, since the contact faces of the coating martial bag 9 and the operating fluid bag 10 reciprocate in the coating material discharge chamber 9 as if they were a single sheet of diaphragm D, as shown in FIGS. (*a*) to (*c*), this can provide an effect that respective bags are less creased or broken.

Further, if the operating fluid bag should happen to be broken, since the coating material is filled in the coating material bag, there is no worry that the coating material and the operating fluid should be mixed in the coating material discharge chamber.

In this embodiment, it has been described that the ports of the coating material bag 9 and the operating fluid bag 10 are disposed in one identical direction, but the ports for the bags 9 and 10 may be situated so as to be opposite to each other depending on the structure of the cartridge 34.

In a case of binding the contact faces of the bags 9 and 10, they are not bond only by adhesion or welding but may be bond by engaging bags to each other.

FIG. 6 shows one example. In this embodiment, a coating material bag 51 and an operating fluid bag 52 are formed each as a tubular body 53. The tube 53 has a protruded port 54 formed at the top end and a bottom seal 55 bent into a lug having an engaging hole 56. When the bags 51 and 52 are engaged, the hole 56 of one of bags allows the port 54 of the other bag to be inserted therein According to this embodiment, when the seal portions 55 of the respective bag 51 and 52 are bent and the respective ports 54 and 54 are inserted into the engaging holes 56, 56 of the other tube thereby binding the contact faces 57, 57 thereof to each other.

As has been described above, the present invention is extremely useful when used to an electrostatic coating machine for conductive coating material.

The present disclosure relates to subject matter contained in priority Japanese Patent Applications No. 2003-322,146 filed on Sep. 12, 2003 and No. 2004-114,307 filed on Apr. 8, 2004, the contents of which is herein expressly incorporated by reference in its entirety.

What is claimed is:

1. A coating machine having a coating material discharger configured to discharge a coating material under pressure to an atomizer wherein a coating material bag for filling the coating material is housed in a coating material discharging chamber of a predetermined volume, and an inlet/exit port of an operating fluid is disposed in the material discharging chamber for exerting a pressure from outside of the coating material bag thereby discharging the coating material under pressure;

wherein plural coating material bags are provided in the coating material discharging chamber, and switching valves are interposed in coating material discharge flow channels from each of the coating material bags to the atomizer to selectively supply the coating material from one of the coating material bags to the atomizer during entering of the operating fluid.

2. The coating machine according to claim 1, wherein the coating material bag is formed in one of a tubular shape and a balloon shape, and having a connection port formed at one end thereof.

3. The coating machine according to claim 1, wherein the inside of the coating material discharge chamber is formed as a cylindrical inner peripheral surface.

4. The coating machine according to claim 1, wherein an electrostatic atomizer is provided as the atomizer to electrically charge conductive coating material particles to be atomized to or a polarity opposite to that of an object to be coated.

* * * * *